US011819720B2

(12) United States Patent
Kopp et al.

(10) Patent No.: US 11,819,720 B2
(45) Date of Patent: Nov. 21, 2023

(54) FIRE-FIGHTING NOZZLE, FIRE-FIGHTING SYSTEM AND METHOD FOR OPERATING A FIRE-FIGHTING SYSTEM

(71) Applicant: FOGTEC Brandschutz GmbH, Cologne (DE)

(72) Inventors: Rüdiger E. Kopp, Cologne (DE); Ulrich Hiltemann, Wermelskirchen (DE)

(73) Assignee: FOGTEC Brandschutz GmbH, Cologne (DE)

( * ) Notice: Subject to any disclaimer, the term of this patent is extended or adjusted under 35 U.S.C. 154(b) by 0 days.

(21) Appl. No.: 17/924,879

(22) PCT Filed: Apr. 7, 2021

(86) PCT No.: PCT/EP2021/058986
§ 371 (c)(1),
(2) Date: Nov. 11, 2022

(87) PCT Pub. No.: WO2021/228470
PCT Pub. Date: Nov. 18, 2021

(65) Prior Publication Data

US 2023/0191177 A1 Jun. 22, 2023

(30) Foreign Application Priority Data

May 12, 2020 (DE) ..... 10 2020 112 805.3

(51) Int. Cl.
*A62C 35/68* (2006.01)
*A62C 31/02* (2006.01)
(Continued)

(52) U.S. Cl.
CPC ..... *A62C 35/68* (2013.01); *A62C 31/02* (2013.01); *A62C 35/62* (2013.01); *A62C 37/10* (2013.01); *A62C 37/14* (2013.01)

(58) Field of Classification Search
CPC ..... A62C 31/02; A62C 31/05; A62C 35/62; A62C 35/68; A62C 37/10; A62C 37/11; A62C 37/14
See application file for complete search history.

(56) References Cited

U.S. PATENT DOCUMENTS

2004/0144549 A1* 7/2004 Sundholm ..... A62C 37/14 169/37
2014/0158383 A1 6/2014 Hansen

FOREIGN PATENT DOCUMENTS

CN 1378474 A 11/2002
CN 111298348 A * 6/2020 ..... A62C 37/17
(Continued)

OTHER PUBLICATIONS

China National Intellectual Property Administration, Notification of the First Office Action, Application No. 202180042411.5, dated Mar. 1, 2022, 10 pages.
(Continued)

*Primary Examiner* — Darren W Gorman
(74) *Attorney, Agent, or Firm* — Sunstein LLP

(57) ABSTRACT

A fire-fighting nozzle includes a tubular inlet having an inlet opening, the inlet extending along a longitudinal axis from the inlet opening toward a shut-off valve, a tubular outlet having at least one nozzle opening, the outlet extending along a transverse axis transverse to the longitudinal axis toward the nozzle opening, and a sealing valve being arranged between the inlet and the nozzle opening and sealing the outlet in a sealing region with respect to the inlet. A radial distance of the sealing region from the longitudinal axis is smaller than or equal to a smallest radial distance of the inner circumferential surface of the inlet opening from the longitudinal axis in a region between the inlet opening and the sealing region.

12 Claims, 5 Drawing Sheets

(51) Int. Cl.

| | |
|---|---|
| ***A62C 35/62*** | (2006.01) |
| ***A62C 37/10*** | (2006.01) |
| ***A62C 37/14*** | (2006.01) |

(56) References Cited

FOREIGN PATENT DOCUMENTS

| | | | | | |
|---|---|---|---|---|---|
| DE | 102007042691 | A1 * | 3/2009 | ..... | A62C 35/68 |
| GB | 2 390 018 | A | 12/2003 | | |
| JP | 2000-153005 | A | 6/2000 | | |
| JP | 2006305376 | A | 11/2006 | | |
| JP | 2013192752 | A | 9/2013 | | |
| KR | 200457601 | Y1 | 12/2011 | | |
| WO | 2016071869 | A1 | 5/2016 | | |

OTHER PUBLICATIONS

International Searching Authority/EP; International Search Report and Written Opinion, Application No. PCT/EP2021/058986, dated Jul. 5, 2021, with English translation of ISR, 17 pages.

* cited by examiner

FIRE-FIGHTING NOZZLE, FIRE-FIGHTING SYSTEM AND METHOD FOR OPERATING A FIRE-FIGHTING SYSTEM

CROSS-REFERENCE TO RELATED APPLICATIONS

This application is the national phase entry of international patent application no. PCT/EP2021/058986 filed Apr. 7, 2021 and claims the benefit of German patent application No. 10 2020 112 805.3 filed May 12, 2020, the disclosures of which are incorporated herein by reference in their entirety.

TECHNICAL FIELD

The subject matter relates to a fire-fighting nozzle, a fire-fighting system, and a method of operating a fire-fighting system.

BACKGROUND ART

Fire-fighting systems with thermally activated nozzles are usually either dry-biased or wet-biased. The advantage of dry-biased systems is their frost resistance, since in the idle state, i.e. when no fire has been detected and the system is ready for operation, the supply lines and firefighting nozzles are free of extinguishing fluid, in particular water.

Liquid extinguishing fluid, especially water, even if it has additives, is subject to the risk of freezing, and when it freezes, the natural expansion of the water can cause damage to the piping and nozzles. This problem does not exist initially with dry-biased systems.

However, when such dry-biased fire-fighting systems are activated, i.e., moved from their rest state to the active state in the event of a fire or fire alarm, the piping is flooded with extinguishing fluid. The extinguishing fluid flows through the piping and reaches the fire-fighting nozzles. The extinguishing fluid is expelled from the system by the triggering fire-fighting nozzles. These firefighting nozzles must be replaced after successful firefighting.

On the other hand, however, those firefighting nozzles that were not triggered during activation remain mounted in the system after activation. However, due to the flooding of the piping system during activation, the supply lines to these firefighting nozzles are also flooded with extinguishing fluid.

After replacing the activated fire-fighting nozzles, the piping of the system is drained and the system is dry-biased again. After draining, there should be no more extinguishing fluid in the piping. However, the extinguishing fluid that remains as residue in those fire-fighting nozzles that have not been triggered is problematic. It cannot always be ensured that the extinguishing fluid flows out of all fire-fighting nozzles when emptied, driven by gravity. However, this non-draining extinguishing fluid represents a significant potential for damage, as it can freeze and then cause damage on site due to its expansion.

Due to installation space constraints, Fire-fighting systems, especially the piping, are usually mounted below the ceiling. In the simplest case, the firefighting nozzles could be installed in the angled section of the piping facing the ceiling so that it drains naturally, gravity-driven. In this case, however, the fire-fighting nozzles are oriented toward the ceiling and would initially discharge the extinguishing fluid toward the ceiling in the event of activation.

The effect can be minimized by constructive measures, but the pipeline running underneath represents an obstacle to spraying. This limits the spread of the extinguishing fluid and its distribution.

However, since fire-fighting nozzles are qualified for a specific application, their location in the room is relevant for correct installation. A fire-fighting nozzle that is qualified for a vertically downward application cannot be readily used in an upward, particularly vertically upward, direction. This would be contrary to the qualification and would be an installation defect.

The effort to qualify fire-fighting nozzles is considerable, so that there is a need to be able to install already qualified fire-fighting nozzles in dry-biased fire-fighting systems in a frost-proof manner.

Thus, the subject matter was based on the object of providing a firefighting nozzle, a firefighting system and a method that allows frost-proof use in dry-biased firefighting systems.

SUMMARY OF THE INVENTION

A fire-fighting nozzle of the subject matter may be provided with either a sprinkler nozzle insert or a fog nozzle insert. When a fog nozzle insert is used, the extinguishing fluid is finely atomized, in particular with high pressure in the event of a fire, which promises a particularly good fire-fighting success.

The extinguishing fluid is in particular water, but can also be another liquid. Whenever water is mentioned in the following, any other liquid extinguishing fluid can also be meant. Whenever extinguishing fluid is mentioned in the following, water or any other liquid extinguishing fluid can in any event be meant.

The present fire-fighting system is in particular a dry-biased fire-fighting system. The pipelines of the dry-biased fire-fighting system are pressurized with a rest gas pressure in the rest state. Fire detection means, which in particular can also be arranged directly at the fire-fighting nozzle, can detect a fire, for example by a rising temperature. In such a case, the fire detection means are triggered and allow gas to escape from the piping system. The associated pressure loss can be detected and the Fire-fighting system can be flooded with extinguishing fluid.

At those firefighting nozzles that are assigned to the fire, e.g. because they have been triggered, the extinguishing water can escape and be used to fight the fire. After the fire has been successfully fought, the extinguishing water is drained from the piping system and the activated fire-fighting nozzles are replaced. However, firefighting nozzles that have not been activated remain in the system.

For draining the non-replaced firefighting nozzles, the nozzles have a tubular inlet with an inlet opening, the inlet extending along a longitudinal axis from the inlet opening in the direction of a sealing valve. The fire-fighting nozzle is attached to a pipeline with an inlet opening and extinguishing fluid can enter the tubular inlet via the inlet opening and flow from there in the direction of the sealing valve. In the installed state of the nozzle, the longitudinal axis is horizontal. The position of the longitudinal axis relative to the horizontal preferably has a tolerance range of −5 up to 45°.

The shut-off valve may be closed in the rest state and open only in the activation state.

A tubular outlet with at least one nozzle opening may be provided on the shut-off valve, the outlet extending along a transverse axis transverse to the longitudinal direction towards the nozzle opening. That is, the inlet and outlet or longitudinal axis and transverse axis extend in an L-shape relative to each other. The inlet is a first leg along a first direction and the outlet is a second leg along a second direction. This allows the fire-fighting nozzle to be positioned on the pipework at a suspended ceiling installation and the discharge direction of the nozzle orifice to be positioned downwardly. This allows those nozzle inserts to be inserted into the nozzle openings that are qualified for a downward spray pattern. By aligning the outflow direction in the installation position essentially vertically, any spray pattern can be generated by the nozzle, especially in the downward area, since the area below is free of spray obstacles in the form of piping.

However, the height of the nozzle is less than if the inlet and outlet extended along a common axis.

The shut-off valve is located between the inlet and the nozzle opening. The shut-off valve is arranged to seal the outlet from the inlet in a sealing area when not in use. Thus, extinguishing fluid cannot pass from the inlet via the sealing area to the nozzle opening. For this purpose, the shut-off valve must first open, which only happens in the case of activation.

After activation, the nozzle must be drained. For this purpose, it is now proposed that a radial distance of the sealing area from the longitudinal axis is smaller than or equal to a smallest radial distance of the inner circumferential surface of the tubular inlet from the longitudinal axis in an area between the inlet opening and the sealing area. In particular, the longitudinal axis is the center axis of the inlet, especially the tubular inlet. Starting from this central axis, the inner circumferential surface of the tubular inlet has a radial distance. In the area between the inlet opening and the sealing area, the inner lateral surface has a radial distance from the longitudinal axis. This can be constant or variable, stepped or continuous between the inlet opening and the sealing area. The radial distance increases in the tubular inlet starting from the inlet opening towards the sealing area. In particular, the diameter of the tubular inlet tapers in the direction of the sealing area.

The radial distance of the sealing area from the longitudinal axis is smaller than the radial distance from the longitudinal axis in the area between the inlet opening and the sealing area. In particular, the radial distance always increases starting from the sealing area towards the inlet opening in the tubular inlet, and the increase in the radial distance can be continuous and/or gradual. This smallest radial distance in the sealing area ensures that, in a horizontal mounting position of the inlet of the fire-fighting nozzle, extinguishing fluid flows safely and reliably out of the sealing area via the inner circumferential surface out of the fire-fighting nozzle, driven by gravity.

In particular, the fire-fighting nozzle is mounted on the pipeline in a horizontal plane, meaning that the longitudinal axis is in a horizontal plane in the mounting position of the fire-fighting nozzle. The design also allows tolerances from the horizontal, with the range preferably being in the between −5 up to 45° rising towards the sealing valve. In particular, the supply line to the fire-fighting nozzle also runs in this plane. If the radial distance of the sealing area is smaller than any radial distance of the inner lateral surface from the longitudinal axis between the sealing area and the inlet opening, it is then ensured that extinguishing fluid flows from the sealing area towards the inlet opening driven by gravity and thus drains the fire-fighting nozzle.

According to one embodiment, it is proposed that a spring acts on a valve stem of the shut-off valve. This spring can be used to move the shut-off valve from a rest position to an activation position. The shut-off valve can be released for movement when activated, and this movement is caused by the spring force. In particular, the shut-off valve is hinged to fire detection means, in particular mounted to the fire detection means. When the fire detection means is triggered, this bearing is released and the shut-off valve or the valve stem can be moved in the direction of the fire detection means, driven by the spring force. Hereby, the sealing area is released and the extinguishing fluid can flow out of the fire-fighting nozzle.

According to one embodiment, it is proposed that the spring is mounted against a radially inwardly facing collar on the tubular inlet. In particular, the sealing valve moves transversely in the longitudinal direction. Viewed in the longitudinal direction, a fire detection means is located, for example, on the side of the inlet opposite the inlet opening. The inlet opening and fire detection means are thus located at distal ends of the tubular inlet. The spring on the side of the sealing valve facing the inlet opening is mounted on a collar. The collar runs along the inner lateral surface of the inlet and points inwards. This allows the spring to exert a force on the shut-off valve acting in the longitudinal direction away from the inlet opening, which in the event of activation, when the shut-off valve is released, causes the shut-off valve to move transversely along the longitudinal axis in the direction of the fire detection means and the sealing area is released by the shut-off valve. However, this circumferential collar is responsible for the fact that, starting from the inlet opening behind this collar, a volume is created between the collar and the sealing area that cannot be drained by gravity. Now, in order to allow gravity-driven drainage, it is proposed that the collar has an opening (e.g. groove) running in the longitudinal direction, especially in the area of the bottom of the tubular inlet facing the outlet. The opening has a bottom (e.g. groove bottom) which is in particular planar with the inner circumferential surface of the tubular inlet abutting thereon in the direction of the inlet opening, or a smaller radial distance than the tubular inlet towards the inlet opening. The base may be planar with the inner lateral surface of the tubular inlet adjacent thereto in the direction of the sealing region, or may have a greater radial distance than the tubular inlet toward the sealing region. The bottom of the opening may extend longitudinally toward the sealing region beyond the walls of the collar. The base may form a step in the inner lateral surface.

In particular, the walls of the opening extend radially inward. In the installation position, the longitudinal axis runs in a horizontal line. The opening is in particular in the region of the lowest point there of the inner lateral surface of the tubular inlet. The transverse axis then runs vertically in the vertical.

According to one embodiment, it is proposed that the opening spans an arc angle of more than 1 degree and less than 45 degrees. In particular, the opening is provided in the lower region of the inlet. A larger arc angle could lead to the spring no longer having enough contact surface. A smaller arc angle could result in drainage no longer being sufficiently good.

According to one embodiment, it is proposed that the spring is supported against a frontal bottom of the outlet opposite the nozzle opening. In this case, the valve stem of the shut-off valve is mounted so that it can move in particular parallel to the transverse axis. The valve stem is pressed by the spring in the direction of the nozzle opening. When the shut-off valve is released, the valve stem moves in the direction of the nozzle opening due to the spring force.

For this purpose, the spring is mounted on the side of the outlet opposite the nozzle opening and can thus exert a spring force.

According to one embodiment, it is proposed that a spring force of the spring acts on the valve stem in such a way that the valve stem is pressed against a fire detection means and is moved in the direction of the fire detection means when the fire detection means is triggered. In the rest state, the fire detection means exerts a counterforce to the spring force. In the activation state, this force is deactivated and the valve stem can be moved towards the fire detection means by the spring force.

According to one embodiment, it is proposed that the valve stem is mounted movably in the direction of the longitudinal axis or in the direction of the transverse axis. This bearing is particularly suitable for a transversal movement along the longitudinal axis or the transversal axis.

According to one embodiment, it is proposed that the sealing means seals an annular space between the valve stem and the tubular inlet or the tubular outlet. In case of movement of the valve stem in the direction of the longitudinal axis, the sealing means is arranged at the tubular inlet. In the case of movement of the valve stem in the direction of the transverse axis, the sealing means is arranged at the tubular outlet. The sealing means is always arranged in the area of the transition between inlet and outlet. Due to the movement, the sealing means is moved into a region where it no longer creates a seal of the annular space and thus extinguishing fluid can flow from the inlet to the outlet.

According to one embodiment, it is proposed that the cross-section of the tubular inlet is point-symmetrical with respect to the longitudinal axis. Also, it is proposed that the cross-section of the tubular outlet is point-symmetrical with respect to the transverse axis.

According to one embodiment, it is proposed that the nozzle opening is formed for receiving a nozzle insert, in particular for receiving a fog nozzle insert. In particular, the nozzle opening may be formed for a screw insert. A nozzle insert may be formed for the corresponding application purpose and may be, for example, a fogging nozzle or a sprinkler nozzle. This is preferably screwed into the nozzle opening and forms the end of the fire-fighting nozzle. The extinguishing fluid is discharged from the nozzle insert in the case of activation.

According to one embodiment, it is proposed that the inlet opening is formed for arrangement on a mounting fitting of a distribution pipe. An attachment fitting may be, for example, a tee, a tapping clamp, an attachment clamp or the like. In particular, the Fire-fighting nozzle may be bolted thereto. Likewise, the nozzle can also be connected to the pipe network, for example, via press connectors.

According to one embodiment, it is proposed that the fire detection means is a glass barrel. The glass barrel is loaded with a spring force by the spring and the valve stem. In case of fire, the glass barrel bursts and the valve stem is released and moved towards the glass barrel driven by the spring force.

In another aspect, there is provided a fire-fighting system, wherein a supply line supplies extinguishing fluid to the fire-fighting nozzle. A nozzle insert is disposed within the fire-fighting nozzle.

BRIEF DESCRIPTION OF THE DRAWINGS

In the following, the subject matter is explained in more detail with reference to drawings showing embodiments. The drawings show.

DETAILED DESCRIPTION OF SPECIFIC EMBODIMENTS

Figure 1:
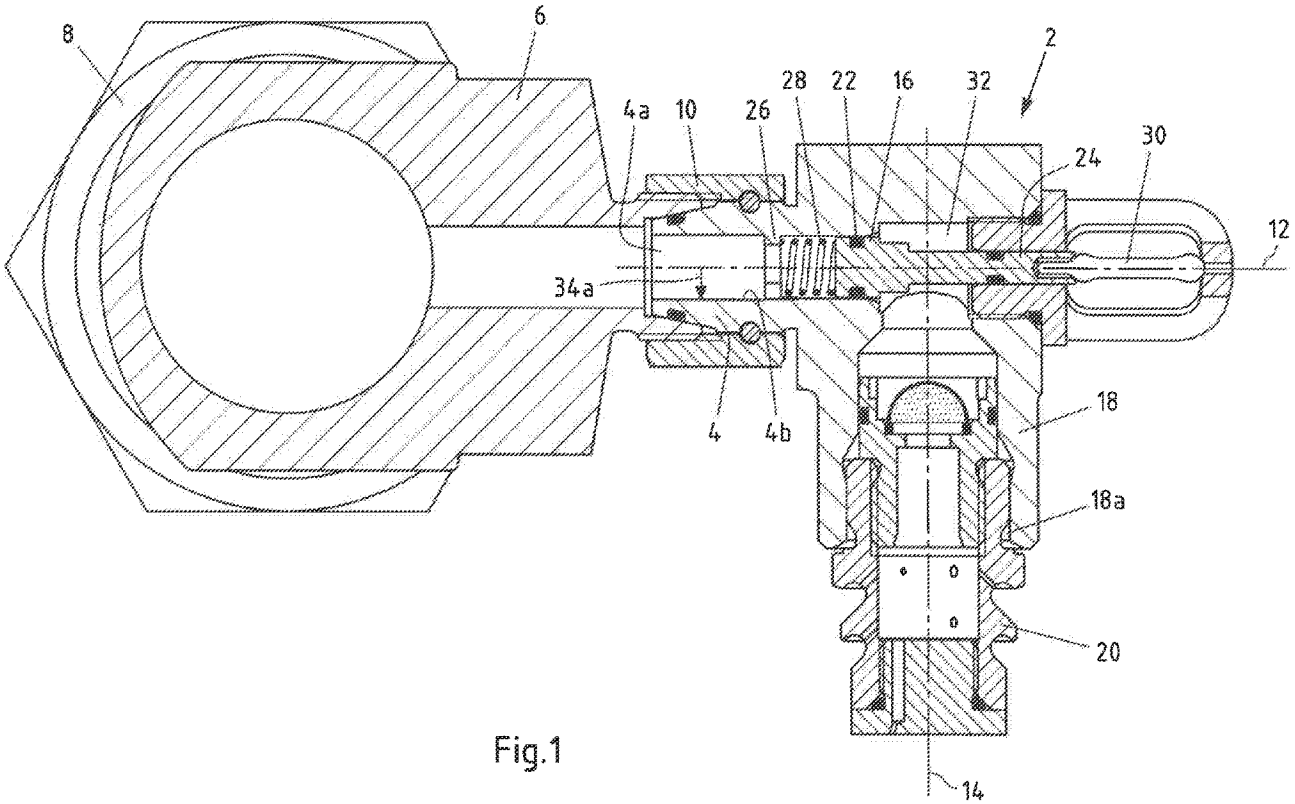
FIG. 1 a section along the longitudinal axis through a fire-fighting nozzle.

FIG. 1 shows a fire-fighting nozzle 2, which is connected by a tubular inlet 4 to a mounting fitting 6 of a pipeline 8. Via the pipeline 8, the fire-fighting nozzle 2 can be flooded with extinguishing fluid in case of activation.

The fire-fighting nozzle 2 is sealingly screwed to the fitting 6 with the inlet 4 via a screw-on clamp 10. The inlet 4 has an inlet opening 4*a*. The inlet opening 4*a* is circumscribed by an inner circumferential surface 4*b* of the inlet 4. The inlet 4 extends along a longitudinal axis 12. In the installed state, the longitudinal axis 12 extends in a horizontal direction. A transverse axis 14 extends transversely to this longitudinal axis 12. In the installed state, the transverse axis 14 extends in particular in the vertical.

The inlet 4 is connected to a tubular outlet 18 via a sealing area 16. The outlet 18 runs along the transverse axis 14. An outlet opening 18*a* is provided at the outlet 18. A nozzle insert 20 can be inserted, in particular screwed, into the outlet opening 18*a*.

In the sealing area 16, a circumferential seal 22 is arranged on a valve stem 24. A collar 26 is arranged on the inner lateral surface 4*b* remote from the inlet opening 4*a* and points radially inwards. A spring 28 is hinged to this collar 26. The spring 28 is tensioned in the rest state. The spring 28 is held in the tensioned state by a glass barrel 30. The valve stem 24 is attached to the glass barrel 30.

The tubular inlet 4 extends between the inlet opening 4*a* and the collar 26, and between the collar 26 and the sealing area 16.

In the rest state, the tubular inlet 8 is subjected to a rest pressure which presses against the valve stem 24. As a result, the glass barrel 30 is pressurized.

If a fire occurs, the increased temperature causes the glass barrel 30 to burst, so that the spring 28 pushes the valve stem 24 out of the inlet 4 in the direction of the longitudinal axis 12. The seal 22 of the sealing area 16 enters a clearance 32, allowing air to escape from the orifice 20 past the seal 22. Such a loss of pressure is detected in the pipeline 8 and results in the pipeline 8 being flooded with an extinguishing liquid. The extinguishing liquid can then come to the nozzle insert 20 via the inlet 4 and the free space 32 and be expelled there.

However, such activation occurs only at nozzles 2 which are located immediately or in close proximity above the fire load. Nozzles remote therefrom do not activate, since the glass barrel 30 does not burst.

Nevertheless, the pipe 8 is flooded and extinguishing fluid also reaches the inlet 4*a* in non-activated nozzles 2, i.e. the area between the collar 26 and the sealing area 16, in particular up to the seal 22.

After successful fire-fighting, the pipeline 8 is emptied. In order to prevent extinguishing fluid from remaining in the nozzle 2, in particular between the inlet opening 4*a* and the seal 22, it is proposed that the radial distance 34*c* of the circumferential surface 4*b* to the longitudinal axis 12 in the sealing area 16 is smaller than or equal to the radial distance 34*a, b* between the inlet opening 4*a* and the sealing area 16.

In particular, this also includes the collar 26, which is a taper of the clear width of the inlet 4*a*. A groove 36 is provided in the collar 26 for this purpose. This is shown in more detail 2*a*.

Figure 2A:
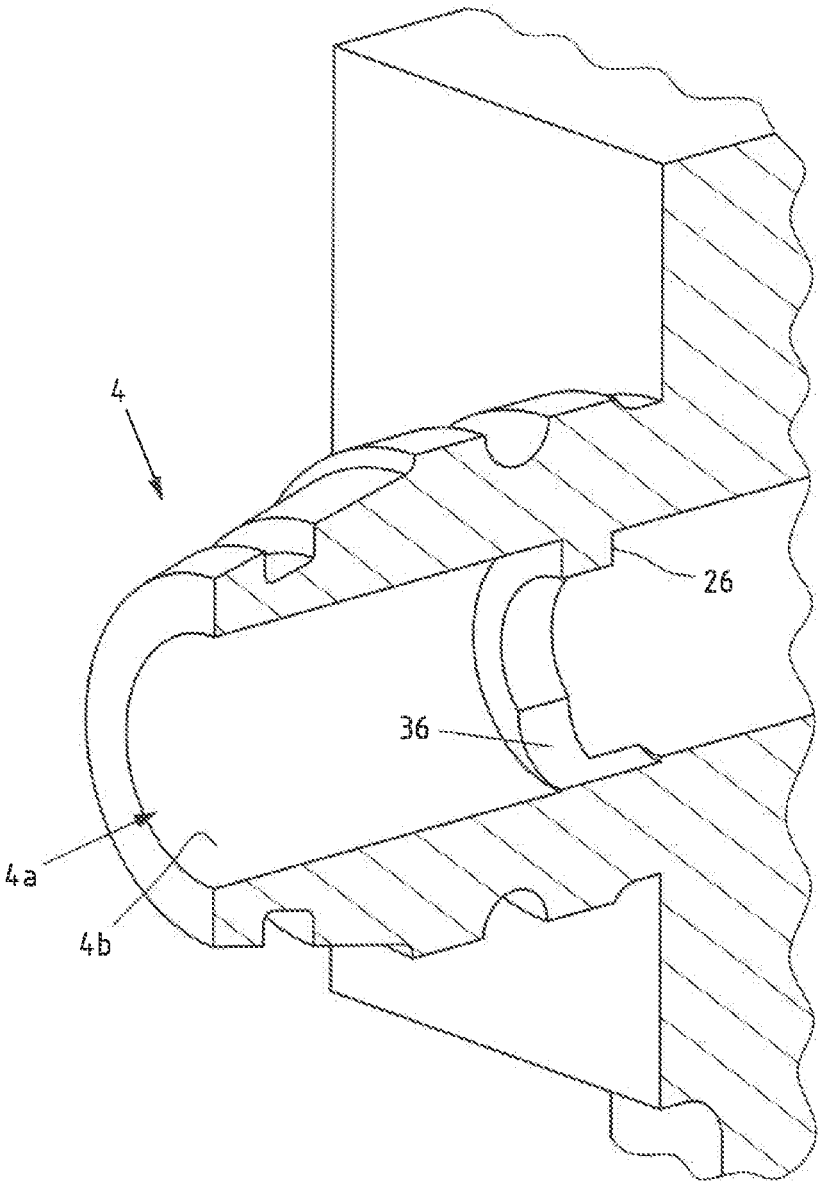
FIG. 2*a* a detail of a drainage system.

FIG. 2*a* shows the inner lateral surface 4*b* of the inlet 4. The collar 26 is provided on the inner lateral surface 4*b* and is circumferential. The spring 28 is hinged to this collar 26. In the bottom region of the inlet 4*a*, however, the collar 26 is provided with a recess, consequently a groove 36. The groove 36 is in the bottom region of the collar 26, in particular in the region of the collar 26 which points in the direction of the nozzle outlet 18*a*. This is vertically downward in the installed condition. The groove bottom extends beyond the groove wall in the direction of the sealing area 16, thus forming a recess on the inner lateral surface 4*b* between the collar 26 and the sealing area 16.

Figure 2B:
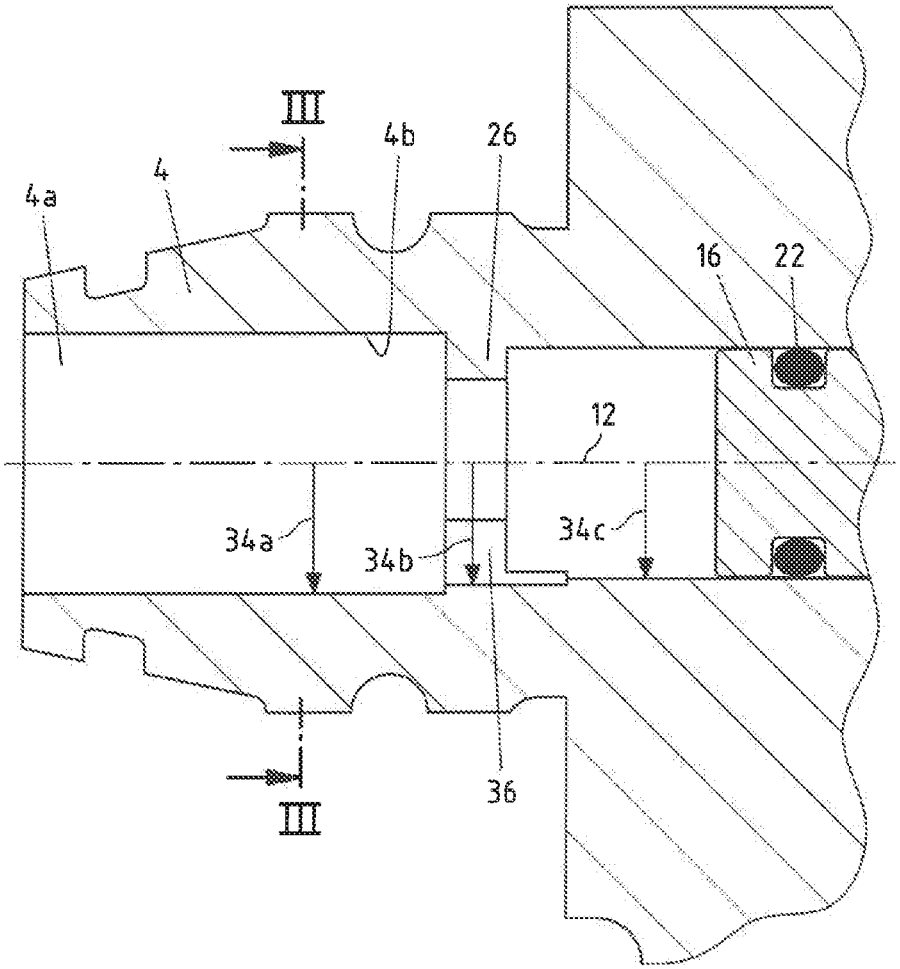
FIG. 2*b* a section through a groove.

FIG. 2*b* shows a longitudinal section at the collar 26. It can be seen that the radial distance 34*a* in the region of the inlet opening 4*a* is greater than the radial distance 34*b* in the region of the groove 26. Further towards the sealing region 16, the radial distance 34*c* becomes smaller again. The radial distance 34*c* there is the smallest of all radial distances 34. The groove 26 extends with its radial distance 34*b* in the longitudinal direction 12 towards the sealing area 16 and forms a step on the lateral surface 4*b*.

This makes it possible to completely empty a non-activated nozzle 2 after fire-fighting has been carried out. The longitudinal axis 12 runs horizontally. Due to the fact that the radial distance 34*c*, starting from the sealing area 16, via the radial distance 34*b* in the area of the groove to the radial distance 34*a* at the inlet opening 4*a*, becomes at least constant, but preferably larger, extinguishing fluid can flow out of the inlet opening 4*a* driven by gravity.

Figure 3:
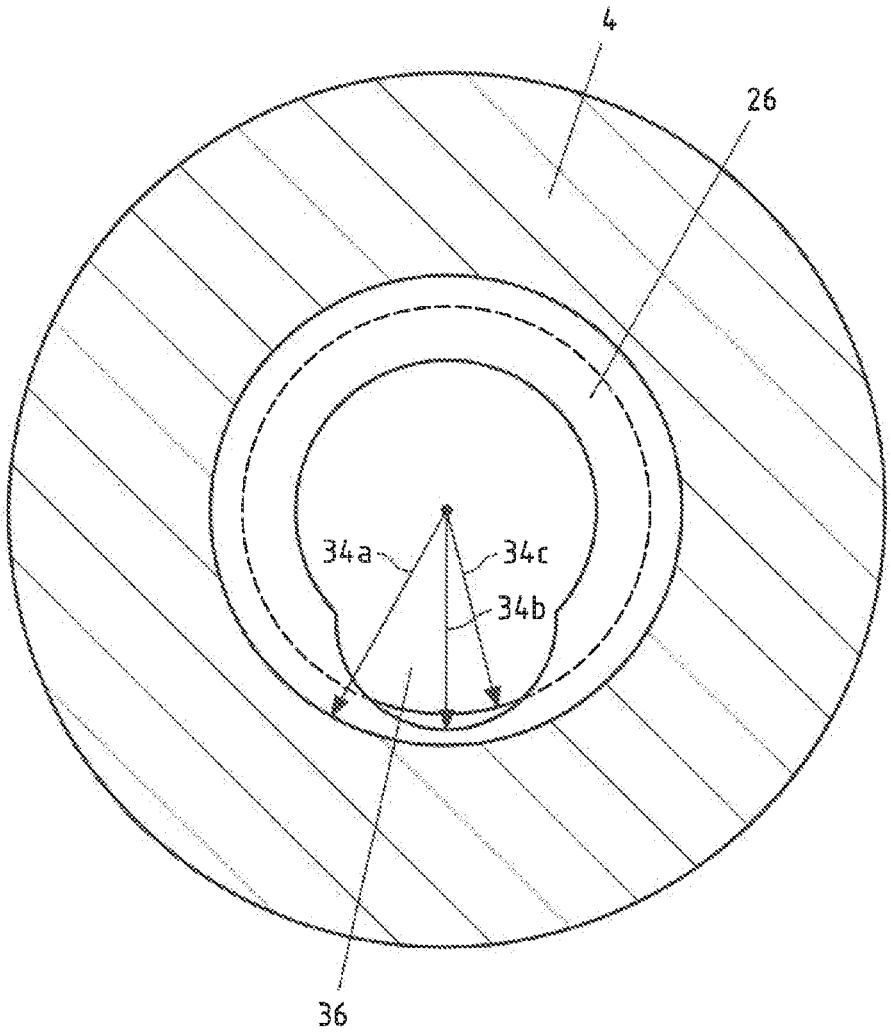
FIG. 3 a section 3 as shown in FIG. 2*b;*

The groove 36 can be seen again in the sectional view according to FIG. 3. There it can be seen that the radial distance 34*c* behind the drawing plane is always smaller than any radial distance 34*b*, a in the direction of the drawing plane.

Figure 4:
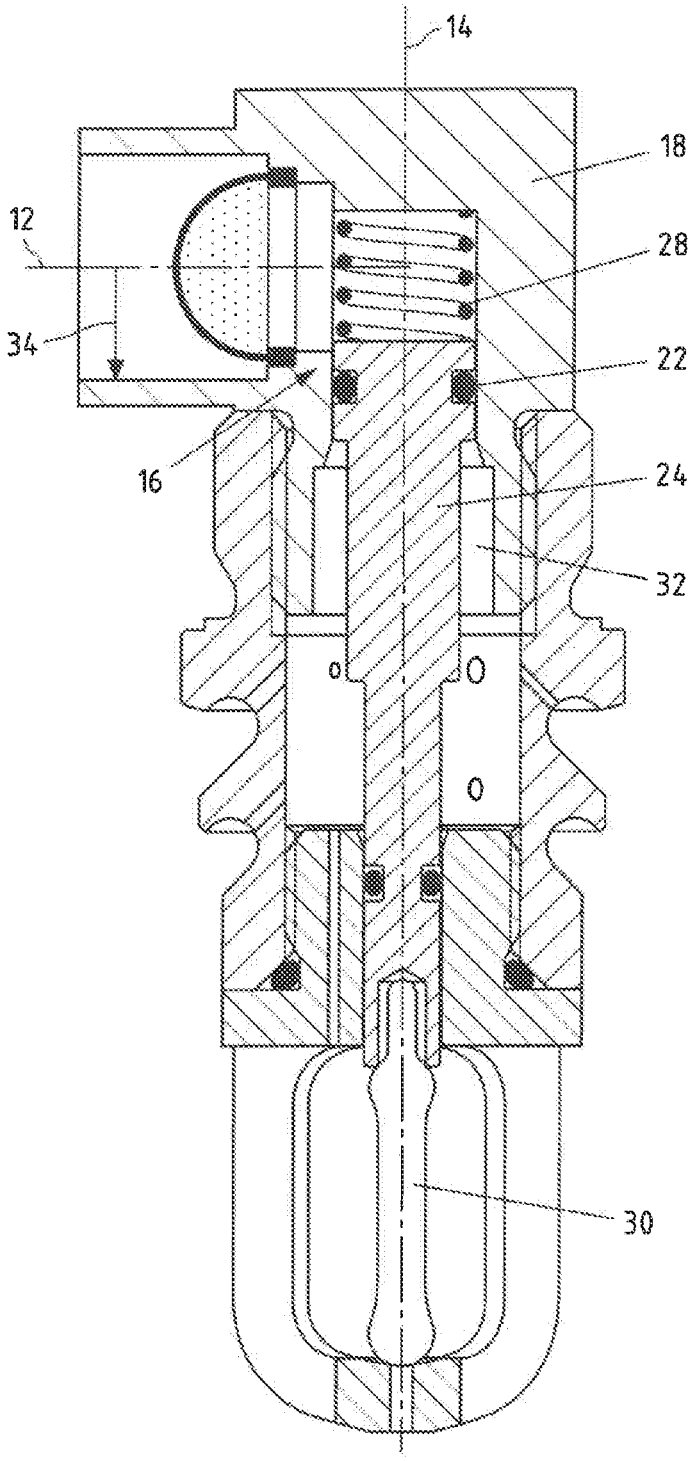
FIG. 4 a longitudinal section along the transverse axis through a fire-fighting nozzle.

It is also possible to mount the valve stem 24 in the outlet 18 so as to be movable along the transverse axis 14, as shown in FIG. 4. By means of the spring 28, the valve stem 24 can be moved in the direction of the glass barrel 30, so that the seal 22 enters the free space 32 and can be flowed around by extinguishing fluid. However, again, it is ensured that a radial distance 34 from the longitudinal axis 12 in the sealing area 16 is less than any radial distance 34 between the sealing area 16 and the inlet opening 4*a*.

With the aid of the nozzle shown, a dry-biased system can be protected from frost damage even after it has been activated.

LIST OF REFERENCE SIGNS

2 fire-fighting nozzle
4 inlet
4*a* inlet opening
4*b* inner lateral surface
6 fitting
8 pipe
10 clamp
12 longitudinal axis
14 transverse axis
16 sealing area
18 outlet
18*a* nozzle outlet
20 nozzle insert
22 gasket
24 valve stem
26 collar
28 spring
30 glass barrel
32 clearance
34 radial clearance
36 groove

What is claimed is:

1. Fire-fighting nozzle comprising:

a tubular inlet having an inlet opening, said inlet extending along a longitudinal axis from said inlet opening toward a shut-off valve, a tubular outlet having at least one nozzle opening, the outlet extending along a transverse axis transverse to the longitudinal axis toward the at least one nozzle opening, wherein the shut-off valve is arranged between the inlet and the at least one nozzle opening and seals the outlet in a sealing region relative to the inlet, wherein a radial distance of the sealing region from the longitudinal axis is smaller than or equal to a smallest radial distance of an inner lateral surface of the inlet opening from the longitudinal axis in a region between the inlet opening and the sealing region;

a spring mounted against a radially inwardly facing collar on the tubular inlet, wherein the spring is arranged to act on a valve stem of the shut-off valve and wherein the collar has an opening extending parallel to the longitudinal axis, in a region of a bottom of the inlet facing the outlet wherein the opening is located at a lowest position of the inner lateral surface of the tubular inlet.

2. Fire-fighting nozzle according to claim 1, wherein the opening spans an arc angle of more than 1° and less than 45°.

3. Fire-fighting nozzle according to claim 1, wherein a spring force of the spring acts on the valve stem in such a way that the valve stem is pressed against a fire detection means and is moved in the direction of the fire detection means when the fire detection means is triggered.

4. Fire-fighting nozzle according to claim 1, wherein the valve stem is mounted movably in the direction of the longitudinal axis or in the direction of the transverse axis.

5. Fire-fighting nozzle according to claim 1, wherein sealing means seals an annular space between the valve stem and the tubular inlet or the tubular outlet.

6. Fire-fighting nozzle according to claim 1, wherein the cross-section of the inlet is point-symmetrical with respect to the longitudinal axis.

7. Fire-fighting nozzle according to claim 1, wherein the cross-section of the outlet is point-symmetrical to the transverse axis.

8. Fire-fighting nozzle according to claim 1, wherein the at least one nozzle opening is formed for receiving a fog nozzle insert.

9. Fire-fighting nozzle according to claim 1, wherein the inlet opening is formed for arrangement on a mounting fitting of a distribution pipe.

10. Fire-fighting nozzle according to claim 3, wherein the fire detection means is a glass barrel.

11. Fire-fighting system comprising:

a supply line;

at least one fire-fighting nozzle according to claim 1, connected to the supply line; and a nozzle insert arranged in the at least one fire-fighting nozzle.

12. A method of operating a fire-fighting system according to claim 11, comprising:

initially flooding the supply line with extinguishing fluid in a fire event; and draining the supply line after the fire has been extinguished, the extinguishing fluid flowing completely out of the area between the inlet opening and the sealing region via the inlet opening's inner circumferential surface.

* * * * *